US008576263B2

(12) United States Patent
Correa et al.

(10) Patent No.: US 8,576,263 B2
(45) Date of Patent: Nov. 5, 2013

(54) METHOD AND APPARATUS FOR PROCESSING VIDEO PICTURES

(75) Inventors: Carlos Correa, Villingen-Schwenningen (DE); Sébastien Weitbruch, Kappel (DE); Mohamed Abdallah, Munich (DE)

(73) Assignee: Thomson Licensing, Boulogne-Billancourt (FR)

( * ) Notice: Subject to any disclaimer, the term of this patent is extended or adjusted under 35 U.S.C. 154(b) by 1147 days.

(21) Appl. No.: 11/999,565

(22) Filed: Dec. 6, 2007

(65) Prior Publication Data

US 2008/0204372 A1 Aug. 28, 2008

(30) Foreign Application Priority Data

Dec. 20, 2006 (EP) ..... 06301274

(51) Int. Cl.
*G09G 5/10* (2006.01)
*G09G 3/38* (2006.01)

(52) U.S. Cl.
USPC ..... 345/691; 345/68

(58) Field of Classification Search
USPC ..... 345/60, 61, 691, 63, 68
See application file for complete search history.

(56) References Cited

U.S. PATENT DOCUMENTS 6,661,470 B1 12/2003 Kawakami
7,176,939 B2 2/2007 Weitbruch et al.
2004/0183820 A1* 9/2004 Kawahara et al. ..... 345/690
2005/0237277 A1* 10/2005 Kawahara ..... 345/63
2006/0050979 A1 3/2006 Kawahara

FOREIGN PATENT DOCUMENTS

| | | |
|---|---|---|
| EP | 1271461 | 1/2003 |
| EP | 1522964 | 4/2005 |
| JP | 11085101 | 3/1999 |
| JP | 200369922 | 3/2003 |
| JP | 2005115384 | 4/2005 |

OTHER PUBLICATIONS

Search report dated Jun. 6, 2007.

* cited by examiner

*Primary Examiner* — Kevin M Nguyen
(74) *Attorney, Agent, or Firm* — Robert D. Shedd; Jerome G. Schaefer

(57) ABSTRACT

A method and apparatus for processing video pictures for dynamic false contour effect compensation. Each video picture is divided into at least a first type and second type of area according to the video gradient of the picture. A specific video gradient range is associated to each type. First and second sets of sub-field code words are allocated to the first and second types respectively. The second set is a subset of the first set. The pixels of the first and second types are encoded with the first and second sets of sub-field code words respectively. For at least one horizontal line of pixels including pixels of the first and second type, the area of second type is extended until the next pixel in the first type area is a pixel encoded by a sub-field code word belonging to both first and second set of sub-field code words.

9 Claims, 9 Drawing Sheets

METHOD AND APPARATUS FOR PROCESSING VIDEO PICTURES

This application claims the benefit, under 35 U.S.C. §119 of EP Patent Application 06301274.4 filed 20 Dec. 2006.

FIELD OF THE INVENTION

The present invention relates to a method and an apparatus for processing video pictures especially for dynamic false contour effect compensation.

BACKGROUND OF THE INVENTION

The plasma display technology now makes it possible to achieve flat colour panels of large size and with limited depth without any viewing angle constraints. The size of the screens may be much larger than the classical CRT picture tubes would have ever allowed.

Plasma Display Panel (or PDP) utilizes a matrix array of discharge cells, which could only be "on" or "off". Therefore, unlike a Cathode Ray Tube display device or a Liquid Crystal Display device in which gray levels are expressed by analog control of the light emission, a PDP controls gray level by a Pulse Width Modulation of each cell. This time-modulation is integrated by the eye over a period corresponding to the eye time response. The more often a cell is switched on in a given time frame, the higher is its luminance or brightness. Let us assume that we want to dispose of 8 bit luminance levels i.e. 255 levels per color. In that case, each level can be represented by a combination of 8 bits with the following weights:

1-2-4-8-16-32-64-128

To realize such a coding, the frame period can be divided in 8 lighting sub-periods, called sub-fields, each corresponding to a bit and a brightness level. The number of light pulses for the bit "2" is the double as for the bit "1"; the number of light pulses for the bit "4" is the double as for the bit "2" and so on . . . . With these 8 sub-periods, it is possible through a combination to build the 256 gray levels. The eye of the observers integrates over a frame period these sub-periods to catch the impression of the right gray level. The FIG. 1 shows such a frame with eight sub-fields.

The light emission pattern introduces new categories of image-quality degradation corresponding to disturbances of gray levels and colors. These is defined as "dynamic false contour effect" since it corresponds to disturbances of gray levels and colors in the form of an apparition of colored edges in the picture when an observation point on the PDP screen moves. Such failures on a picture lead to the impression of strong contours appearing on homogeneous area. The degradation is enhanced when the picture has a smooth gradation, for example like skin, and when the light-emission period exceeds several milliseconds.

When an observation point on the PDP screen moves, the eye follows this movement. Consequently, it no more integrates the same cell over a frame (static integration) but it integrates information coming from different cells located on the movement trajectory and it mixes all these light pulses together, which leads to a faulty signal information.

Basically, the false contour effect occurs when there is a transition from one level to another with a totally different sub-field code. The European patent application EP 1 256 924 proposes a code with n sub-fields which permits to achieve p gray levels, typically p=256, and to select m gray levels, with m<p, among the $2^n$ possible sub-fields arrangements when working at the encoding or among the p gray levels when working at the video level so that close levels have close sub-field codes i.e. sub-field codes with close temporal centers of gravity. As seen previously, the human eye integrates the light emitted by Pulse Width Modulation. So if you consider all video levels encoded with a basic code, the temporal center of gravity of the light generation for a sub-field code is not growing with the video level. This is illustrated by the FIG. 2. The temporal center of gravity CG2 of the sub-field code corresponding to a video level 2 is superior to the temporal center of gravity CG3 of the sub-field code corresponding to a video level 3 even if 3 is more luminous than 2. This discontinuity in the light emission pattern (growing levels have not growing gravity center) introduces false contour. The center of gravity of a code CG(code) is defined as the center of gravity of the sub-fields 'on' weighted by their sustain weight:

$$CG(\text{code}) = \frac{\sum_{i=1}^{n} sfW_i * \delta_i(\text{code}) * sfCG_i}{\sum_{i=1}^{n} sfW_i * \delta_i(\text{code})}$$

where—$sfw_i$ is the sub-field weight of $i^{th}$ sub-field;

$\delta_i$ is equal to 1 if the $i^{th}$ sub-field is 'on' for the chosen code, 0 otherwise; and $SfCG_i$ is the center of gravity of the $i^{th}$ sub-field, i.e. its time position.

The center of gravity $SfCG_i$ of the seven first sub-fields of the frame of FIG. 1 are shown in FIG. 3.

So, with this definition, the temporal centers of gravity of the 256 video levels for a 11 sub-fields code with the following weights, 1 2 3 5 8 12 18 27 41 58 80, can be represented as shown in FIG. 4. As it can be seen, this curve is not monotonous and presents a lot of jumps. These jumps correspond to false contour. The idea of the patent application EP 1 256 924 is to suppress these jumps by selecting only some levels, for which the gravity center grows smoothly. This can be done by tracing a monotone curve without jumps on the previous graphic, and selecting the nearest point.

Such a monotone curve is shown in FIG. 5. It is not possible to select levels with growing gravity center for the low levels because the number of possible levels is low and so, if only growing gravity center levels were selecting, there will not be enough levels to have a good video quality in the black levels since the human eye is very sensitive in the black levels. In addition the false contour in dark areas is negligible. In the high level, there is a decrease of the gravity centers. So, there will be a decrease also in the chosen levels, but this is not important since the human eye is not sensitive in the high level. In these areas, the eye is not capable to distinguish different levels and the false contour level is negligible regarding the video level (the eye is only sensitive to relative amplitude if we consider the Weber-Fechner law). For these reasons, the monotony of the curve is necessary just for the video levels between 10% and 80% of the maximal video level.

In this case, 40 levels (m=40) are selected among the 256 possible levels. These 40 levels permit to keep a good video quality (gray-scale portrayal). This is the selection that can be made when working at the video level, since only few levels, typically 256, are available. But when this selection is made at the encoding, there are $2^n$ different sub-field arrangements, and so more levels can be selected as seen on the FIG. 6, where each point corresponds to a sub-field arrangement (there are different sub-field arrangements giving a same video level).

The main idea of this Gravity Center Coding, called GCC, is to select a certain amount of code words in order to form a good compromise between suppression of false contour effect (very few code words) and suppression of dithering noise (more code words meaning less dithering noise).

The problem is that the whole picture has a different behavior depending on its content. Indeed, in area having smooth gradation like on the skin, it is important to have as many code words as possible to reduce the dithering noise. Furthermore, those areas are mainly based on a continuous gradation of neighboring levels that fits very well to the general concept of GCC as shown on FIG. 7. In this figure, the video level of a skin area is presented. It is easy to see that all levels are near together and could be found easily on the GCC curve presented. The FIG. 8 shows the video level range for Red, Blue and Green mandatory to reproduce the smooth skin gradation on the woman forehead depicted on the FIG. 7. In this example, the GCC is based on 40 code words. As it can be seen, all levels from one color component are very near together and this suits very well to the GCC concept. In that case we have almost no false contour effect in those area with a very good dithering noise behavior if there are enough code words, for example 40.

However, let us analyze now the situation on the border between the woman forehead and the woman hairs as presented on the FIG. 9. In that case, we have two smooth areas (skin and hairs) with a strong transition in-between. The case of the two smooth areas is similar to the situation presented before. In that case, we have with GCC almost no false contour effect combined with a good dithering noise behavior since 40 code words are used. The behavior at the transition is quite different. Indeed, the levels required to generate the transition are levels strongly dispersed from the skin level to the hair level. In other words, the levels are no more evolving smoothly but they are jumping quite heavily as shown on the FIG. 10 for the case of the red component.

In the FIG. 10, we can see a jump in the red component from 86 to 53. The levels in-between are not used. In that case, the main idea of the GCC being to limit the change in the gravity center of the light cannot be used directly. Indeed, the levels are too far each other and, in that case, the gravity center concept is no more helpful. In other words, in the area of the transition the false contour becomes perceptible again. Moreover, it should be added that the dithering noise is also less perceptible in strong gradient areas, which enable to use in those regions less GCC code words more adapted to false contour.

So a solution is to select locally the best coding scheme (in terms of noise/dynamic false contour effect trade-off) for every area in the picture. In this way, the gradient based coding disclosed in the European patent application EP 1 522 964 can be a good solution to reduce or remove the false contour effect when the video sequence is coded by a gravity center coding of EP 1 256 924. The idea is to use a "normal" gravity center coding for areas that have a smooth gradation (low gradient) in the signal level, and a reduced set of codes (=a subset of the set of normal gravity center codes) for the areas that undergo a high gradient variation in the signal level (transition). A reduced set of codes comprising 11 code words is for example shown in FIG. 11. This reduced set has an optimal behaviour in terms of false contour for these regions but the regions where it is applied must be carefully selected in order to not introduce dithering noise. The selection of the regions where the reduced set of codes is applied is made by a gradient extraction filter. FIG. 12 shows the gradient regions detected by a gradient extraction filter in the picture of FIG. 7. The high gradient regions are displayed in white in this figure. The other regions are displayed in black.

So the gradient based coding disclosed in EP 1 522 964 is considered as a good solution to reduce the dynamic false contour effects in the different areas or regions of the picture. But, it remains some dynamic false contour effects on the boundary between two areas (i.e. between an area coded by codes of a reduced set (high gradient) and an area coded by codes of a "normal" set (low gradient)). Dynamic false contour effects are introduced due to the shift between the two sets of codes. This is mainly due to a non optimal selection of the boundary position where the two neighbouring pixels are coded with two different codes that are not fully compatible even if coming from the same skeleton.

SUMMARY OF THE INVENTION

It is a subject of this invention to remove at least a part of the remaining false contour effects.

As the set of codes needed for coding the high gradient areas is itself a subset from the set of codes needed for coding the other areas of the picture, it is proposed according to the invention to shift the boundary between the two areas and to put it, for each horizontal line of pixels, at a pixel that can be coded by a code belonging to the two sets. So, the picture areas coded by codes of the high gradient set are extended. It comes from the observation that there is almost no false contour effect between any two neighbouring pixels coded by two codes belonging to the same set.

So the invention concerns a method for processing video pictures for dynamic false contour effect compensation, each pixel of the video pictures having at least one colour component (RGB), the colour component values being digitally coded with a digital code word, hereinafter called sub-field code word, wherein to each bit of a sub-field code word a certain duration is assigned, hereinafter called sub-field, during which a colour component of the pixel can be activated for light generation, comprising the steps of:

- dividing each of the video pictures into at least a first type of area and a second type of area according to the video gradient of the picture, a specific video gradient range being associated to each type of area,
- allocating a first set of sub-field code words to the first type of area and a second set of sub-field code words to the second type of area, the second set being a subset of the first set,
- encoding the pixels of the first type of area with the first set of sub-field code words and encoding the pixels of the second type of area with the second set of sub-field code words, wherein, for at least one horizontal line of pixels comprising pixels of first type area and pixels of second type area, the area of second type is extended until the next pixel in the first type area is a pixel encoded by a sub-field code word belonging to both first and second set of sub-field code words.

Thus, if it is possible to shift the boundary between two areas coded by two different sets of codes and to put it at a pixel that can be coded by a code belonging to the two sets, dynamic false contour effects are absolutely eliminated.

Preferably, the extension of the second type area is limited to P pixels.

In a specific embodiment, P is a random number comprised between a minimum number and a maximum number.

In a specific embodiment, the number P changes at each line or at each group of m consecutive lines.

In a specific embodiment, in each set of sub-field code words, the temporal centre of gravity for the light generation of the sub-field code words grows continuously with the corresponding video level except for the low video level range up to a first predefined limit and/or in the high video level range from a second predefined limit. The video gradient ranges are advantageously non-overlapping and the number of codes in the sets of sub-field code words decreases as the average gradient of the corresponding video gradient range gets higher.

The invention concerns also an apparatus for processing video pictures for dynamic false contour effect compensation, each pixel of the video pictures having at least one colour component (RGB), the colour component values being digitally coded with a digital code word, hereinafter called sub-field code word, wherein to each bit of a sub-field code word a certain duration is assigned, hereinafter called sub-field, during which a colour component of the pixel can be activated for light generation, comprising:

partitioning module for partitioning each of the video pictures into at least a first type of area and a second type of area according to the video gradient of the picture, a specific video gradient range being associated to each type of area, allocating module for allocating a first set of sub-field code words to the first type of area and a second set of sub-field code words to the second type of area, the second set being a subset of the first set, encoding module for encoding the pixels of the first type of area with the first set of sub-field code words and encoding the pixels of the second type of area with the second set of sub-field code words, wherein, for at least one horizontal line of pixels comprising pixels of first type area and pixels of second type area, the partitioning module extends the area of second type until the next pixel in the first type area is a pixel encoded by a sub-field code word belonging to both first and second set of sub-field code words.

BRIEF DESCRIPTION OF THE DRAWINGS

Exemplary embodiments of the invention are illustrated in the drawings and are explained in more detail in the following description. In the drawings.

DETAILED DESCRIPTION OF PREFERRED EMBODIMENTS

Figure 1:
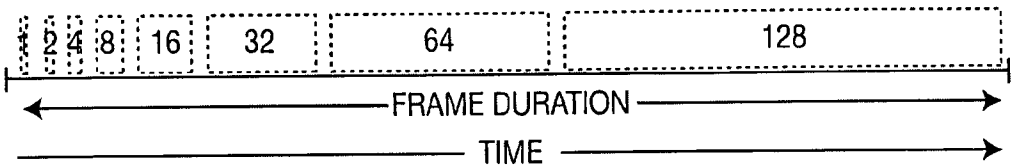
FIG. 1 PRIOR ART
FIG. 1 shows the sub-field organization of a video frame comprising 8 sub-fields.
Figure 2:
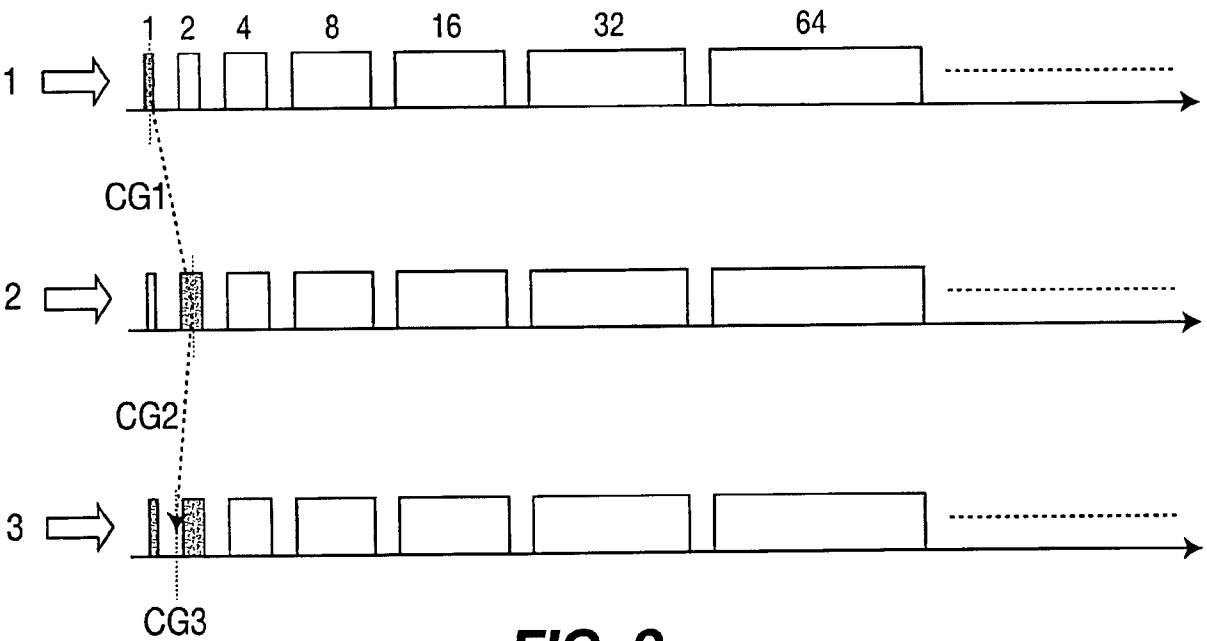
FIG. 2 PRIOR ART
FIG. 2 illustrates the temporal center of gravity of different code words.
Figure 3:
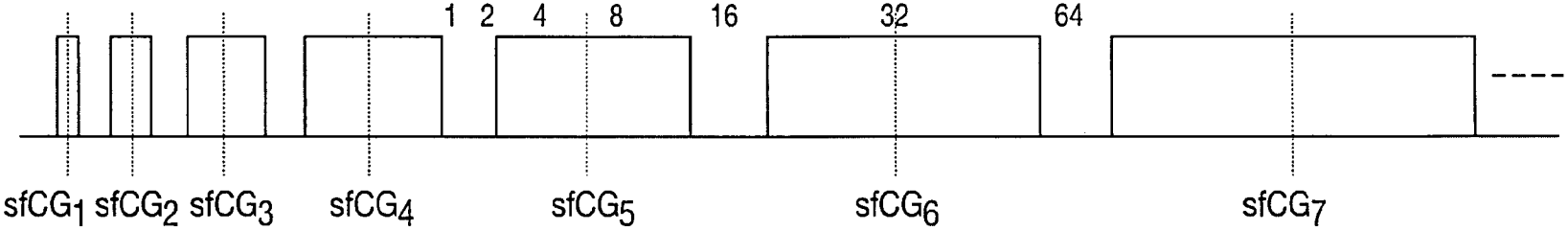
FIG. 3 PRIOR ART
FIG. 3 shows the temporal center of gravity of each sub-field in the sub-field organization of FIG. 1.
Figure 4:
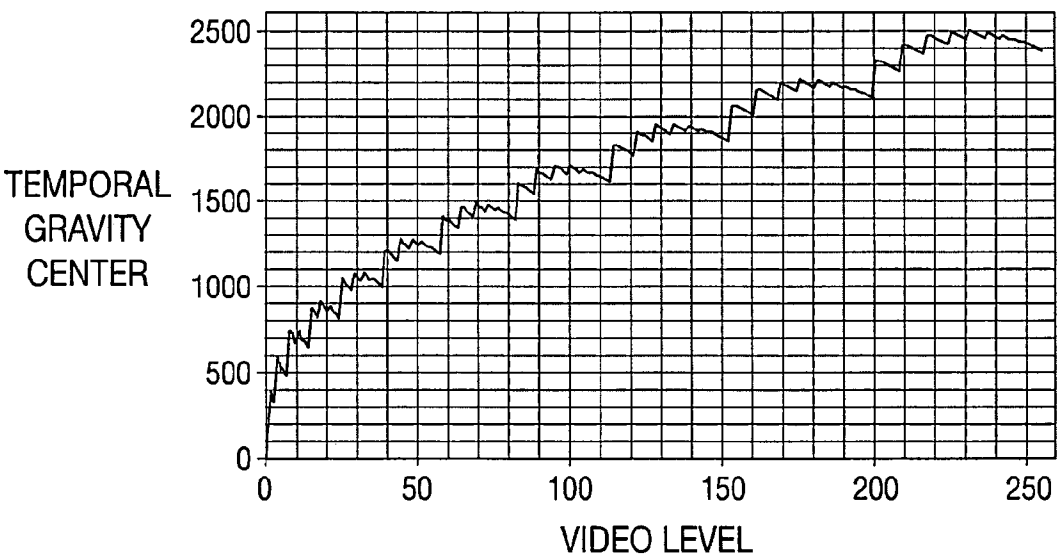
FIG. 4 PRIOR ART
FIG. 4 is a curve showing the temporal centers of gravity of video levels for a 11 sub-fields coding with the weights 1 2 3 5 8 12 18 27 41 58 80.
Figure 5:
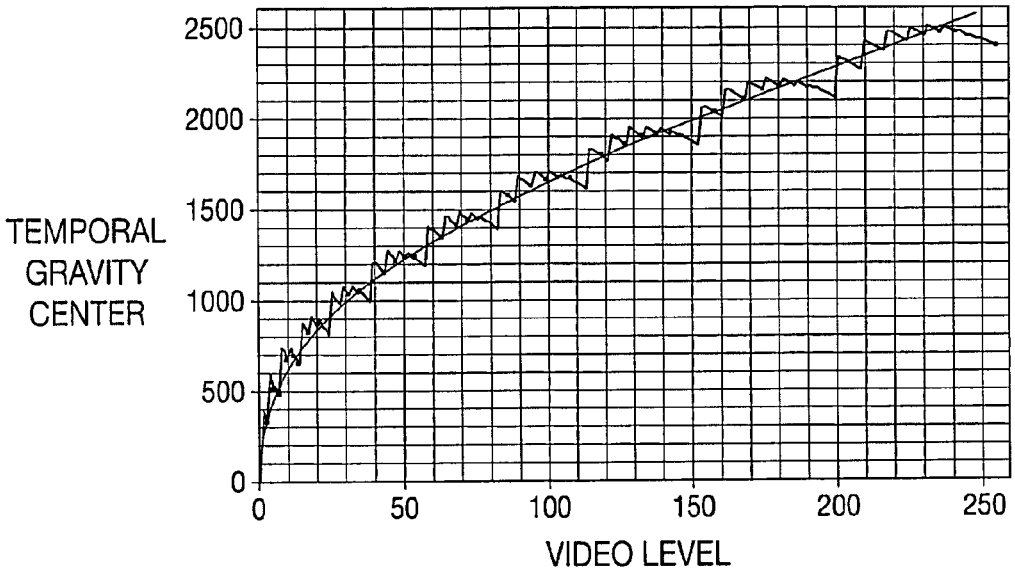
FIG. 5 PRIOR ART
FIG. 5 shows the selection of a set of code words whose temporal centers of gravity grow smoothly with their video level.
Figure 6:
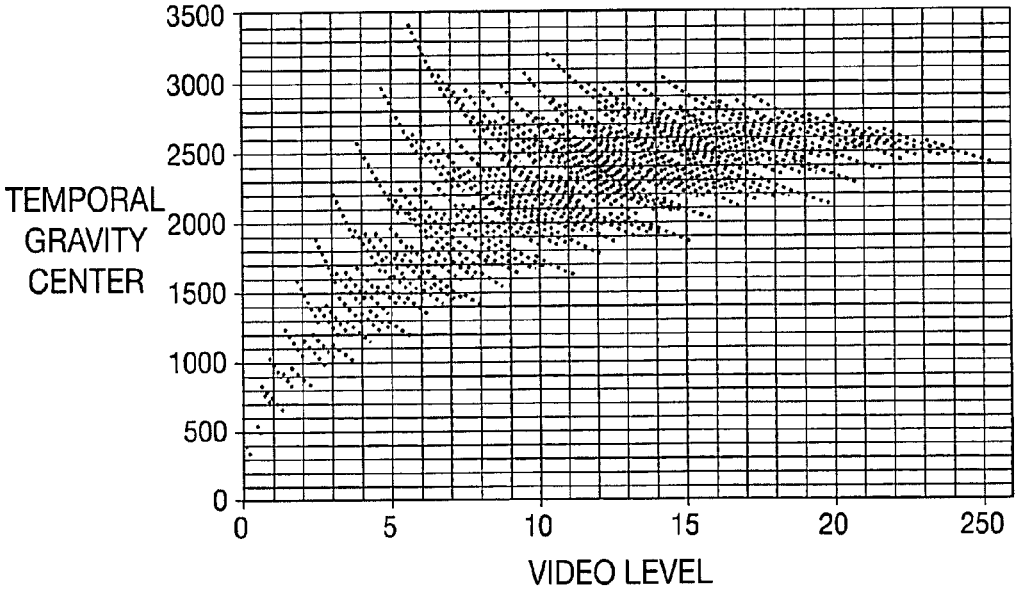
FIG. 6 PRIOR ART
FIG. 6 shows the temporal gravity center of the $2^n$ different sub-field arrangements for a frame comprising n sub-fields.
Figure 7:
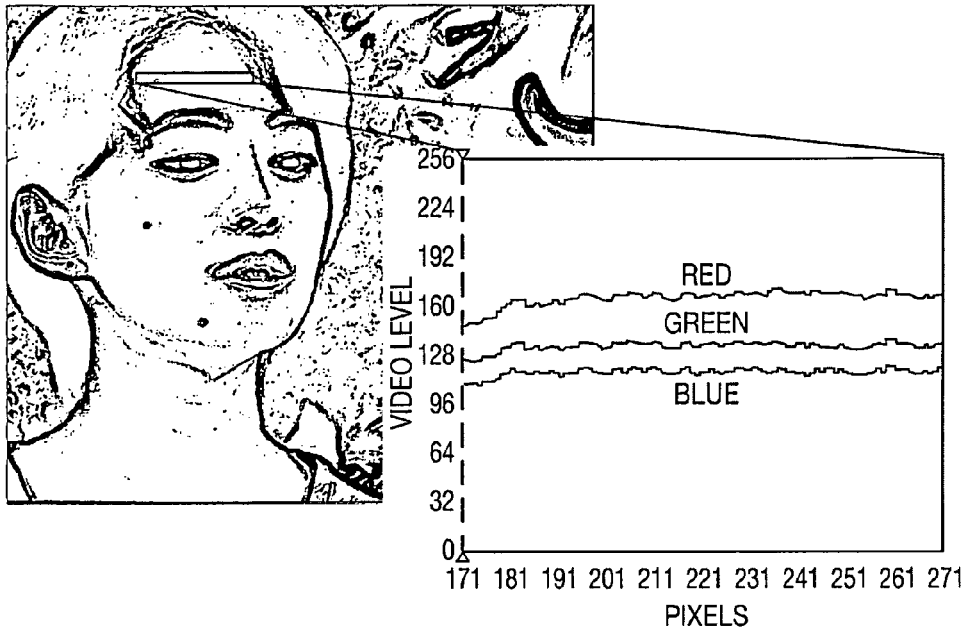
FIG. 7 shows a picture and the video levels of a part of this picture.
Figure 8:
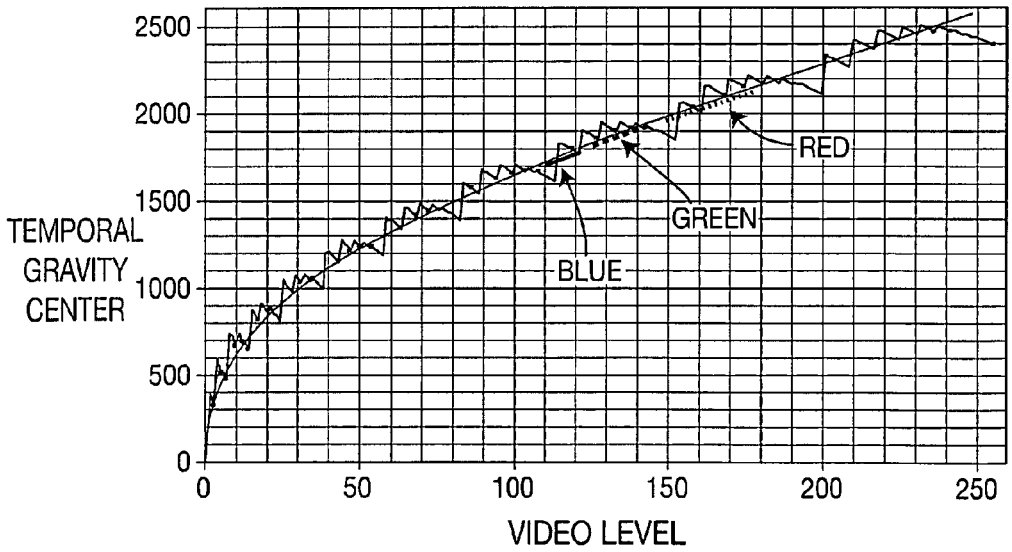
FIG. 8 shows video level ranges used for reproducing this part of picture.
Figure 9:
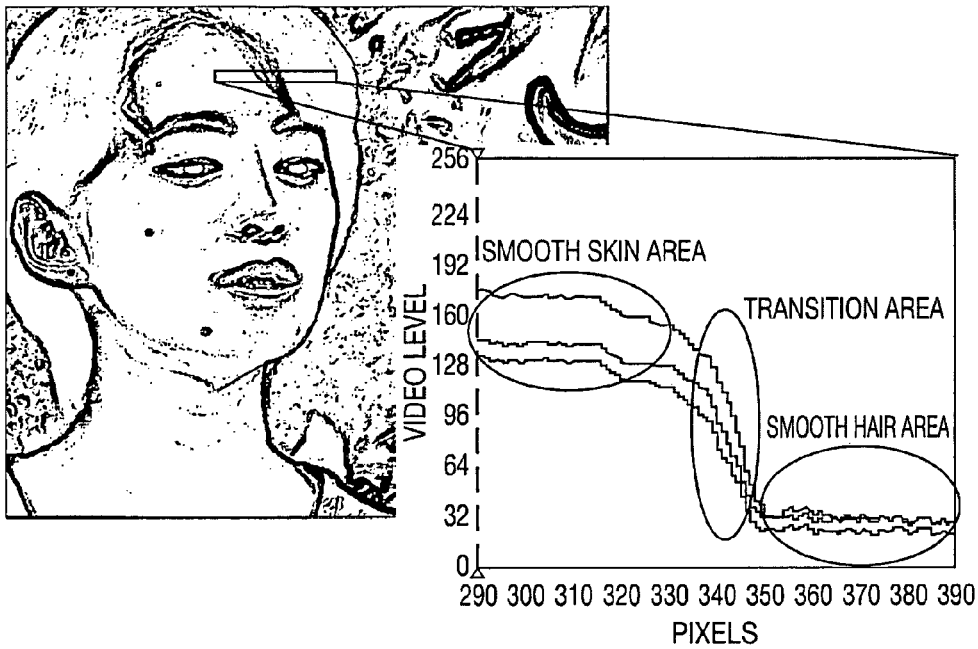
FIG. 9 shows the picture of the FIG. 7 and the video levels of another part of the picture.
Figure 10:
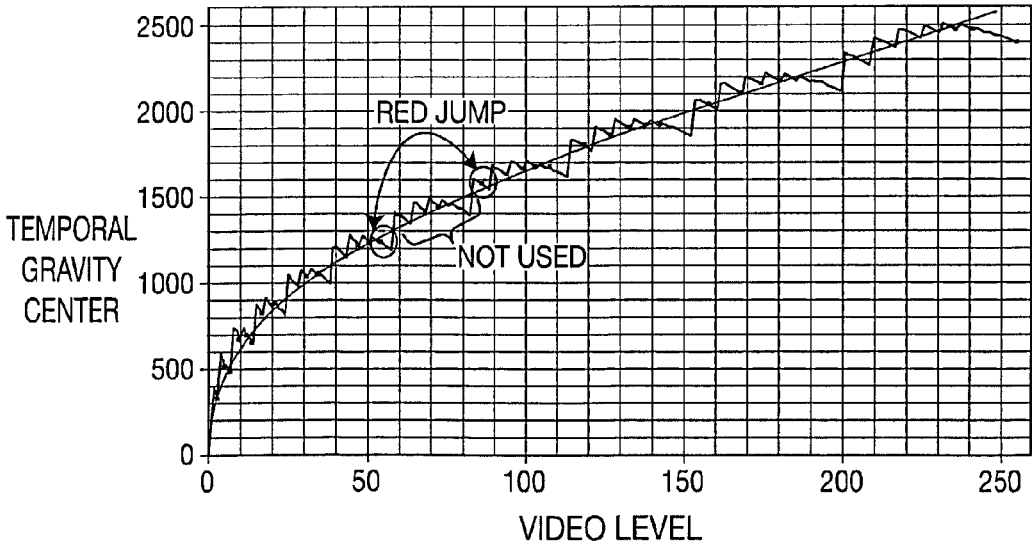
FIG. 10 shows the video level jumps to be carried out for reproducing the part of the picture of FIG. 9.
Figure 11:
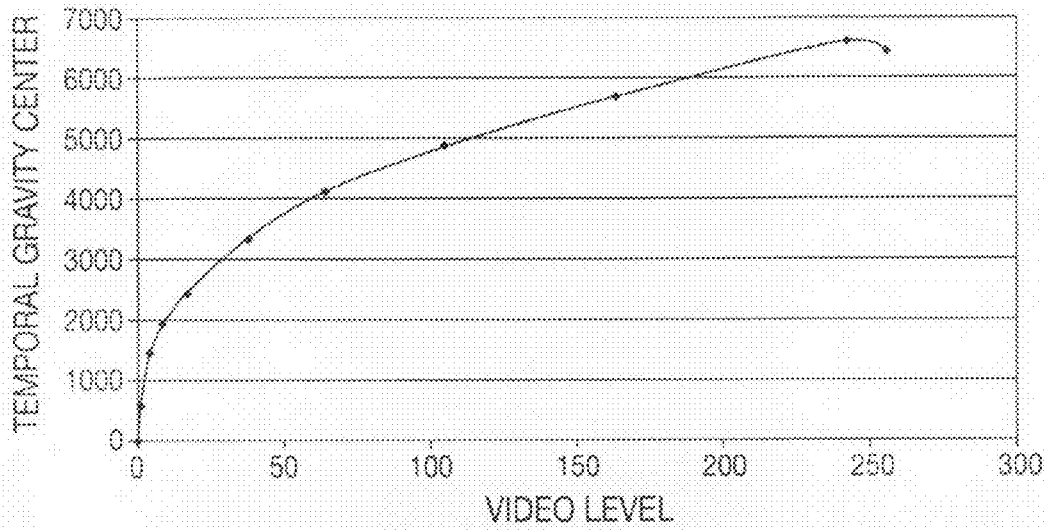
FIG. 11 shows the center of gravity of code words of a set used for reproducing high gradient areas.
Figure 12:
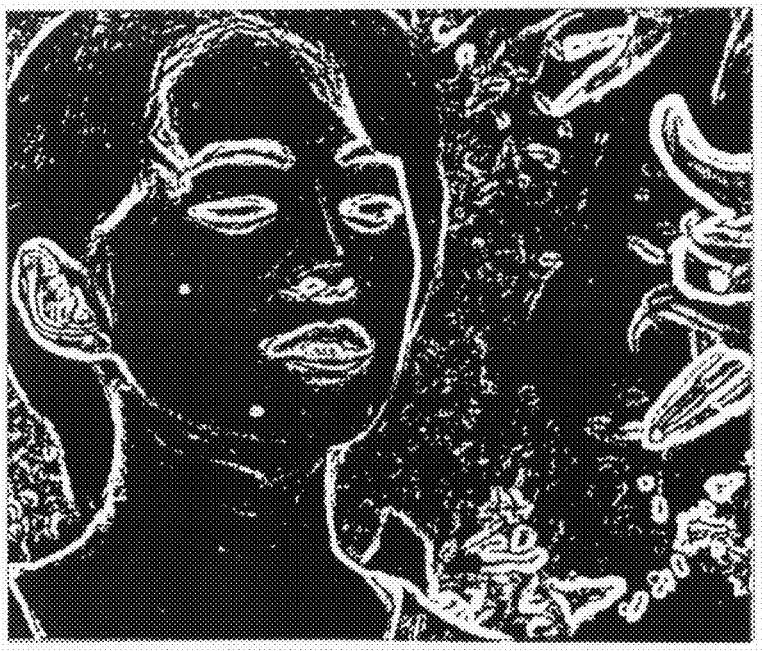
FIG. 12 shows the high gradient areas detected in the picture of FIG. 7 by a gradient extraction filter.
Figure 13:
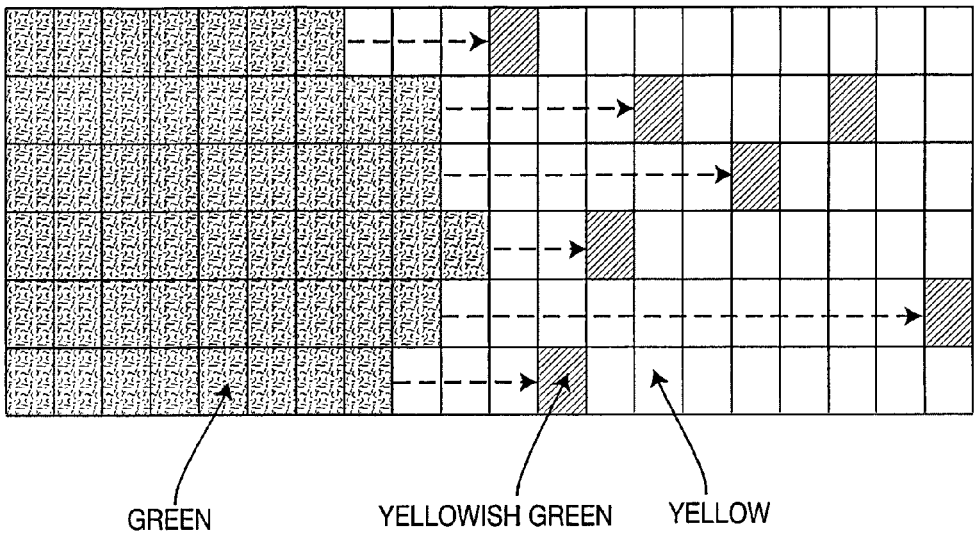
FIG. 13 shows a picture where the pixels at left part of the picture are coded by codes of a first set and the pixels of the right part of the picture are coded by codes of a second set, the first set being included in the second set.

The principle of the invention can be easily understood with the help of FIG. 13. It shows a part of picture comprising 6 lines of 20 pixels. Some of these pixels (shown in yellow) are coded by a first set of codes and the other pixels (shown in green) are coded with a second set of codes. The second set is a subset of the first set i.e. all the codes of the second set are included in the first set. The second set of codes is for example the set used for high gradient areas of the picture as illustrated by FIG. 5 and the first set is the set used for the low gradient areas as illustrated by FIG. 11. In FIG. 13, the pixels coded by codes of the second set are located in the left part of the picture and the pixels coded by codes of the first set are located in the right part of the picture. Since the second set is a subset of the first set, there are some pixels in the yellow area that are coded by codes belonging to both sets. Those pixels are identified in FIG. 13 by the yellowish green colour.

Figure 14:
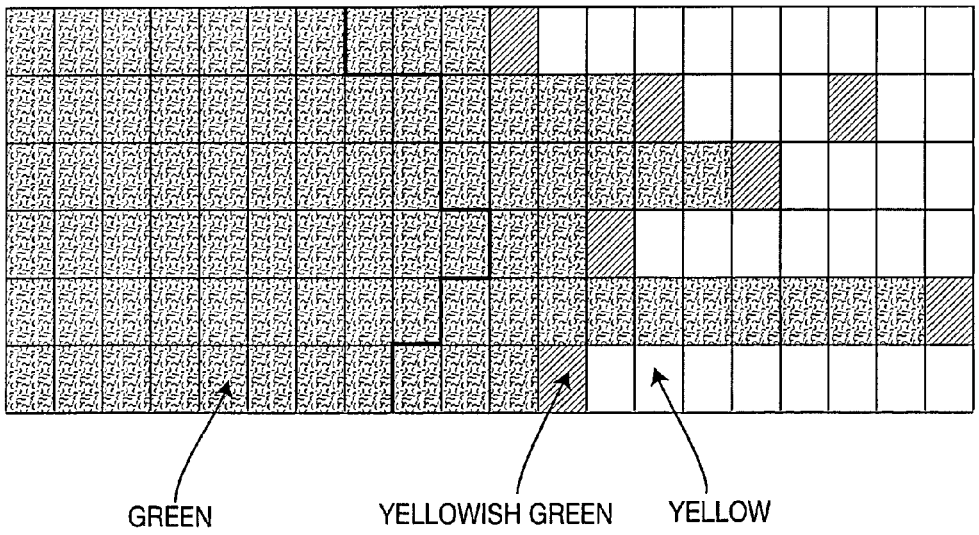
FIG. 14 shows the picture of FIG. 13 where, according to the invention, the area of the pixels coded by the first set is extended for each line of pixels to a pixel coded by a code belonging to the two sets of codes.

The principle of the invention is to shift, for each horizontal line of pixels, the area coded by the second set (the boundary between the area coded by the first set and the area coded by the second set is shifted) until it meets a pixel that can be coded by the two sets (yellowish green pixels). This shift is shown in the FIG. 13 by black arrows. It guarantees that the dynamic false contour effects are eliminated. The reason behind this result is that there is now no light discontinuity between the neighbouring pixels. The result after applying this extension to the picture of FIG. 13 is given by FIG. 14.

In some cases, the pixels (yellowish green pixels) that can be coded by codes of both sets can be far from the initial boundary and it can introduce unnecessary noise in the extended part of the area coded by the second set. Therefore, a criterion for limiting the extension of the area of pixels coded by the second set is advantageously introduced to reduce this noise. So, in a preferred embodiment, the extension of the area including pixels coded by the second set is limited to P pixels for each horizontal line. In this case, the area coded by the second set is extended until it meets a pixel that can be coded by both sets or the extension is equal to P pixels.

Figure 15:
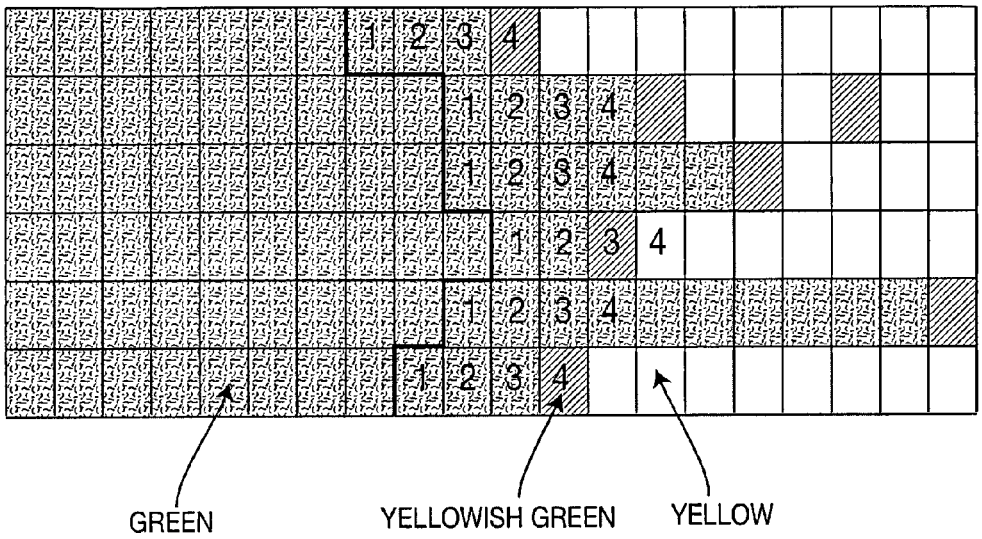
FIG. 15 shows the picture of FIG. 14 where the pixels of the extension have been numbered up to 4 for each line of pixels.
Figure 16:
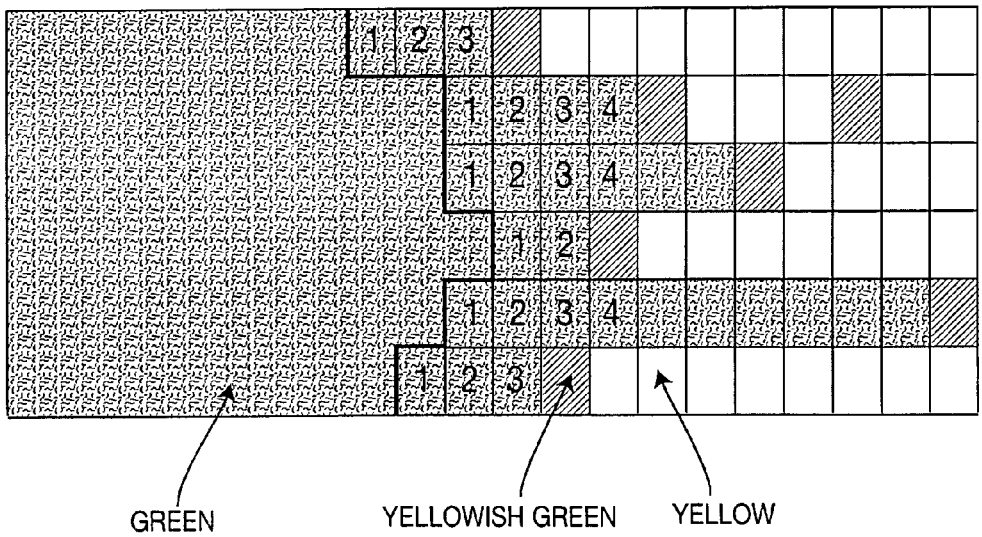
FIG. 16 shows the picture of FIG. 14 where the extension for each line of pixels is limited to 4 pixels.

FIGS. 15 and 16 illustrate a case where the extension is limited to P=4 pixels for each line. FIG. 15 is identical to FIG. 13 except that the pixels of the extension of each line are numbered up to 4. In this example, the extension of the third and fifth lines of pixels exceeds 4 pixels. FIG. 16 shows the results when the extension is limited to 4 pixels for each line.

After limiting the code extension, the dynamic false contour can not be seen even if the extension is not followed by a common pixel (pixel that can be coded by both sets) because the end of the extension is not uniform. The extension stops in a random way. Indeed if it is not possible to eliminate the dynamic false contour effect by extending the area coded by the second set up to a common pixel, then scattering the dynamic false contour effect is a solution. If the initial boundary is random, the dynamic false contour effect is scattered. To be sure that the dynamic false contour effect is scattered, the number P of pixels of the extension is advantageously selected randomly for each line or each group of m consecutive lines in a range of n possible values. For example, the range comprises five values [3, 4, 5, 6, 7] and so P can be randomly one of these five values.

Figure 17:
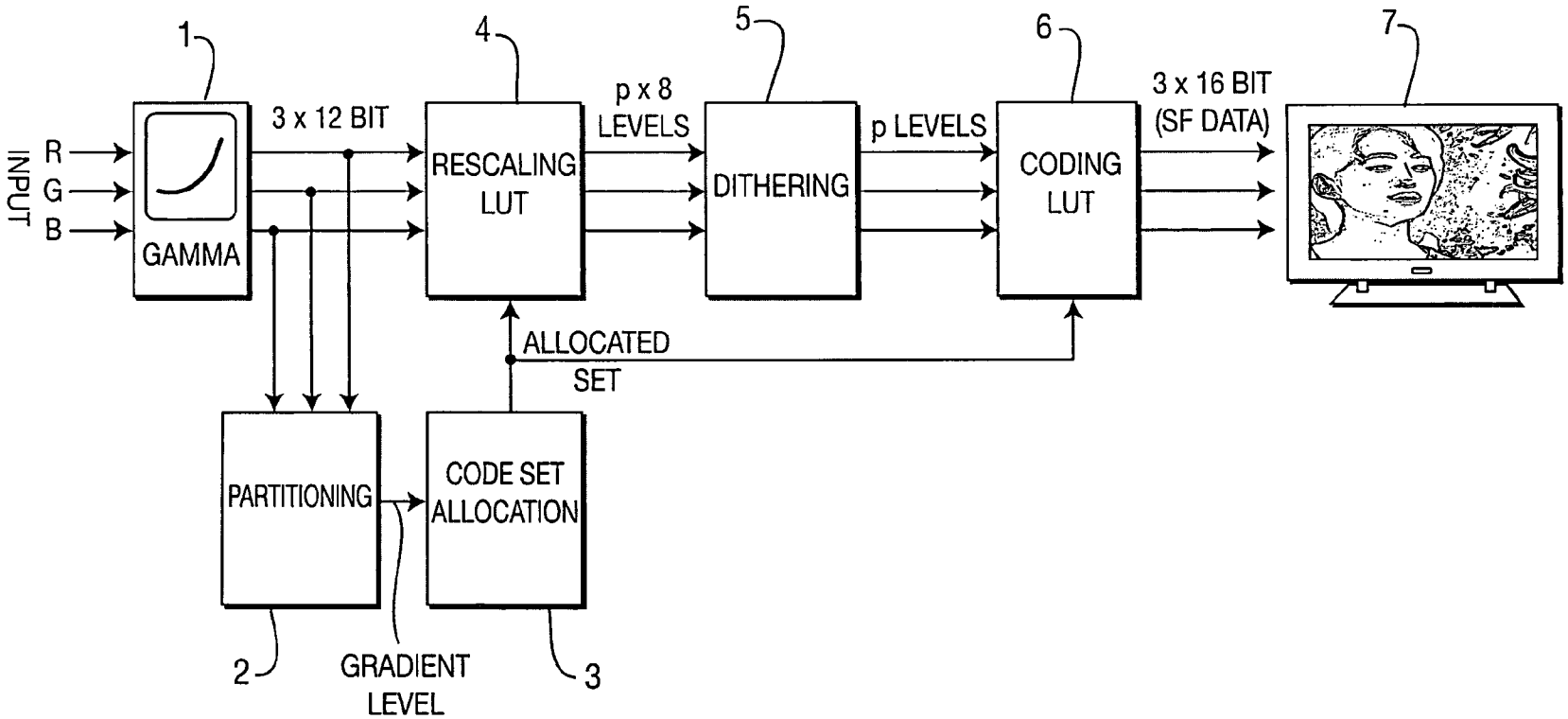
FIG. 17 shows a functional diagram of a device according to the invention.

A device implementing the invention is presented on FIG. 17. The input R, G, B picture is forwarded to a gamma block 1 performing a quadratic function such as for example $$\text{Output} = 4095 \times \left(\frac{\text{Input}}{\text{MAX}}\right)^{\gamma}$$

where γ is around 2.2 and MAX represents the highest possible input video value.

The output signal of this block is advantageously more than 12 bits to be able to render correctly low video levels.

It is forwarded to a partitioning module 2, which is for example a classical gradient extraction filter, to partition the picture into at least first type area (for example high gradient area) and second type area (low gradient area). In theory, it is also possible to perform the partitioning or gradient extraction before the gamma correction. In the case of a gradient extraction it can be simplified by using only the Most Significant Bits (MSB) of the incoming signal (e.g. 6 highest bits). The partitioning information is sent to an allocating module 3, which allocates appropriate set of sub-field codes to be used for encoding current input value. A first set is for example allocated for the low gradient areas of the picture and a second set (which is a subset of the first set) is allocated for the high gradient areas. The extension of the areas coded by the second set as defined before is implemented in this block. Depending on the allocated set, the video has to be rescaled to the number of levels of this set (for example, 11 levels if the code set illustrated by FIG. 11 is used or 40 levels if the code set illustrated by FIG. 5) plus a fractional part which is rendered by dithering. So, based on this allocated set, a resealing LUT 4 and a coding LUT 6 for encoding the input levels into sub-field codes with the allocated set of codes are updated. Between them, a dithering block 7 adds more than 4 bits dithering to correctly render the video signal.

The invention is not limited to the embodiments described previously. In particular, first and second sets of codes other than those presented here can be used.

The invention is applicable to any display device based on a duty-cycle modulation (or pulse width modulation—PWM) of light emission. In particular it is applicable to plasma display panels (PDP) and DMD (digital micro-mirror devices) based display devices.

What is claimed is:

1. Method for processing video pictures for dynamic false contour effect compensation, each pixel of the video pictures having at least one colour component (RGB), the colour component values being digitally coded with a digital code word, hereinafter called sub-field code word, wherein to each bit of a sub-field code word a certain duration is assigned, hereinafter called sub-field, during which a colour component of the pixel can be activated for light generation, comprising the steps of:

dividing each of the video pictures into at least a first type of area and a second type of area according to an amplitude of the image-gradient within the area, the first type of area being a low image-gradient area and the second type of area being a high image-gradient area, allocating a first set of sub-field code words to the first type of area and a second set of sub-field code words to the second type of area, the second set being a subset of the first set, encoding the pixels of the first type of area with the first set of sub-field code words and encoding the pixels of the second type of area with the second set of sub-field code words, wherein, for at least one horizontal line of pixels comprising pixels of first type of area and pixels of second type of area, an area of pixels of the second type is extended in a direction towards pixels of the first type until a next pixel in the first type of area is a pixel encoded by a sub-field code word belonging to both first and second set of sub-field code words.

2. Method according to claim 1, wherein the extension of the second type area is limited to P pixels.

3. Method according to claim 2, wherein P is a random number comprised between a minimum number and a maximum number.

4. Method according to claim 2, wherein the number P changes at each line.

5. Method according to claim 2, wherein the number P changes at each group of m consecutive lines.

6. Method according to claim 1, wherein, in each set of sub-field code words, the temporal centre of gravity (CGi) for the light generation of the sub-field code words grows continuously with the corresponding video level except for the low video level range up to a first predefined limit and/or in the high video level range from a second predefined limit.

7. Method according to claim 6, wherein the video gradient ranges are non-overlapping and the number of codes in the sets of sub-field code words decreases as the average gradient of the corresponding video gradient range gets higher.

8. Method according to claim 7, wherein the first type area comprises pixels having a gradient value lower than or equal to a gradient threshold and the second type area comprises pixels having a gradient value greater than said gradient threshold.

9. Apparatus for processing video pictures for dynamic false contour effect compensation, each pixel of the video pictures having at least one colour component (RGB), the colour component values being digitally coded with a digital code word, hereinafter called sub-field code word, wherein to each bit of a sub-field code word a certain duration is assigned, hereinafter called sub-field, during which a colour component of the pixel can be activated for light generation, comprising:

partitioning module for partitioning each of the video pictures into at least a first type of area and a second type of area according to an amplitude of an image-gradient within the area, a high image-gradient area and a low image-gradient area, allocating module for allocating a first set of sub-field code words to the first type of area and a second set of sub-field code words to the second type of area, the second set being a subset of the first set, encoding module for encoding the pixels of the first type of area with the first set of sub-field code words and encoding the pixels of the second type of area with the second set of sub-field code words, wherein, for at least one horizontal line of pixels comprising pixels of first type of area and pixels of second type of area, the partitioning module extends an area of second type in a direction towards pixels of the first type until a next pixel in the first type of area is a pixel encoded by a sub-field code word belonging to both first and second set of sub-field code words.

* * * * *